United States Patent [19]

Burrage

[11] Patent Number: 4,466,159

[45] Date of Patent: Aug. 21, 1984

[54] ADJUSTABLE TIE STRAP

[76] Inventor: Robert H. Burrage, Stonewood Rd., MR57, York, Pa. 17402

[21] Appl. No.: 452,498

[22] Filed: Dec. 23, 1982

Related U.S. Application Data

[63] Continuation of Ser. No. 281,022, Jul. 6, 1981.

[51] Int. Cl.[3] ..... B65D 63/02

[52] U.S. Cl. ..... 24/16 PB; 24/17 A; 24/17 AP; 24/30.5 P

[58] Field of Search ..... 24/16 PB, 16 R, 17 A, 24/17 B, 17 AP, 30.5 P, 30.5 R, 30.5 S, 30.5 T; 248/74 PB; 292/318, 321

[56] References Cited

U.S. PATENT DOCUMENTS

| | | | |
|---|---|---|---|
| 1,086,442 | 2/1914 | Cornelius | 24/17 A |
| 1,810,027 | 6/1931 | Moran et al. | 24/17 AP |
| 2,784,476 | 3/1957 | Bergdal | 24/16 PB |
| 3,072,986 | 1/1963 | Lefnaer | 24/16 PB |
| 3,102,311 | 9/1963 | Martin et al. | 24/16 PB |
| 3,224,054 | 12/1965 | Lige | 24/16 PB |
| 3,438,095 | 4/1969 | Evans | 24/16 PB |
| 3,486,200 | 12/1969 | Orenick | 24/16 PB |
| 3,913,179 | 10/1975 | Rhee | 24/16 PB |
| 4,077,562 | 3/1978 | Ballin | 24/30.5 P |

FOREIGN PATENT DOCUMENTS

| | | | |
|---|---|---|---|
| 753420 | 7/1949 | Fed. Rep. of Germany | 24/16 PB |
| 1278571 | 10/1961 | France | 24/16 PB |
| 1309873 | 10/1962 | France | 24/16 PB |
| 1438115 | 3/1966 | France | 24/16 PB |
| 654072 | 5/1963 | Italy | 24/16 PB |
| 259578 | 6/1949 | Switzerland | 24/16 PB |
| 381603 | 10/1964 | Switzerland | 24/16 PB |
| 353898 | 7/1931 | United Kingdom | 24/20 EE |
| 698696 | 10/1953 | United Kingdom | 24/17 AP |

*Primary Examiner*—Victor N. Sakran
*Attorney, Agent, or Firm*—C. Hercus Just

[57] ABSTRACT

An elongated plastic strap of uniform width and thickness of material having a series of evenly spaced longitudinally extending rectangular openings therein midway between the edges of the strap and the opposite edges of the portions of the strap between said openings respectively having a series of notches opposite each other and the notches in each row being spaced apart substantially shorter distances than the spacing of the rectangular openings, the inner ends of opposite pairs of the notches being spaced transversely of the strap a distance substantially equal to the transverse width of the rectangular openings and the length of the rectangular openings being substantially equal to the width of said strap, whereby one end of the strap may initially be twisted substantially ninety degrees and inserted through a selected opening and pulled therethrough to form a loop of desired size around an object and then reversely twist the strap to dispose a section between a pair of opposed notches transversely within the opening nearest said notches to secure the loop of the strap around the object and the relatively close spacing of the notches in the rows thereof between the openings permitting close adjustment of the band around an article.

1 Claim, 6 Drawing Figures

ADJUSTABLE TIE STRAP

This application is a continuation of applicant's pending application Ser. No. 281,022, filed July 6, 1981.

BACKGROUND OF THE INVENTION

Adjustable tie straps for various purposes have been developed over a substantial period of time. The type of strap to which the present invention pertains comprises a flexible plastic strap of uniform width and thickness having longitudinally spaced elongated openings between opposite ends thereof and rows of similar notches along opposite edges of the strip for purposes of engagement of a selected pair of opposed notches with the opposite sides of one of the slots, after twisting and inserting one end of the strap through said slot to effect a suitable encircling loop by said strap around a bundle of objects or the neck of a bag, for example, and then reversely twisting the strap in said opening to effect such engagement.

Tie straps of many kinds are very popular at present, one common use thereof being to secure the necks of plastic trash or garbage bags. One very common form of strap to accomplish this comprises a strap of plastic having an elongated opening in one end and V-shaped notches being formed along opposite edges of the strap for engagement of a shoulder of one notch or more in the opposite edges of the slot through which the strap is inserted. Examples of straps of this type are illustrated in prior U.S. Pat. No. 3,102,311 to Martin et al, issued Sept. 3, 1963; U.S. Pat. No. 3,438,095 to Evans, issued Apr. 15, 1969, and U.S. Pat. No. 3,486,200 to Orenick, dated Dec. 30, 1969. There also is a French Pat. No. 1,309,873 to Laguerre, dated Oct. 15, 1962, having another form of the above-described type of strap.

A further form of strap is shown in another French Pat. No. 1,438,115, to Robert, dated Mar. 28, 1966, in which a series of elongated openings are formed in the strip between which a limited number of pairs of opposed notches also are formed and thereby provide a somewhat elaborate type of adjustable means for forming presumably an encircling band although no such band is illustrated.

There also are British Pat. Nos. 353,898 to Brinson, dated July 23, 1931, and 698,696 to North Midland Engineering Co., dated Oct. 21, 1953, which show supporting straps in which limited numbers of openings are formed in a tape, together with very widely spaced notches on opposite edges to form connections especially of the opposite ends in the nature of a sling.

Still other forms of bands are formed in prior U.S. Pat. Nos. 2,784,476 to Bergdal, dated Mar. 12, 1957, and 3,224,054 to Lige, dated Dec. 21, 1965, in which certain openings are formed in tapes, together with notches in opposite edges respectively to form a band around a bundle and secure concrete forms to uprights. The purpose in citing these is to show a full range of pertinent prior art.

The adjustable tie strap of the present invention is for similar purposes as, but of a different nature than, the strap comprising the subject matter of applicant's copending application, Ser. No. 281,022, filed July 6, 1981, entitled Adjustable Tie Strap.

SUMMARY OF THE INVENTION

It is the principal object of the present invention to provide a simple type of tie strap formed preferably from a strip of flexible plastic material having substantial tensile strength and formed inexpensively from a strip of uniform width and thickness by stamping into a strip of indeterminate length of such plastic stock material, intermediately between the opposite edges thereof, a series of longitudinally spaced substantially rectangular openings with the longest dimension thereof extending longitudinally of said strap and such dimension being substantially equal to the width of the strip from which the strap is formed, and also stamping or otherwise cutting or forming into said strip interrupted series of equally spaced notches respectively extending transversely into opposite edges of the strip, said notches in opposite sides of the strip being opposite each other and of uniform depth to provide between the inner ends of said notches a neck portion of the material which is substantially equal to the shorter transverse dimension of the rectangular opening and said opposing series of said notches being formed between each successive opening, whereby a predetermined length of said stock strip, after formation of the openings and notches therein, is cut from said strip to sever the material between a pair of opposed notches to form a tie strap of desired length, whereby one end of said strap may be twisted substantially ninety degrees and said end then is inserted through one of the rectangular openings and pulled therethrough until an encircling loop of the material is formed of desired size around an object, such as, for example, a reefed sail, neck of a closed bag or bundle of objects to secure the same in desired configuration, and then the portion of the strap extending through the selected opening is reversely twisted ninety degrees to dispose the opposite edges of said opening respectively in the pair of notches adjacent the same at that time when the band is encircling the object as tightly as desired.

Another object of the invention is to sever a predetermined length of the strip of material, after formation of the openings and notches therein, transversely across the portion of the material between a pair of opposed notches, whereby opposite ends of the severed strip comprising a strap have somewhat bevelled corners useful to facilitate guiding a selected end of the strap through a selected opening without further requiring any finishing of the ends of the strip constituting a strap of desired length unless further finishing is desired.

Further objects of the invention are, respectively, to form the corners of the rectangular openings and inner ends of the notches with at least small radii to render them arcuate to minimize breaking the strap at those locations; to form the neck portions of the strap with a width greater than the width of the portions of the strap along opposite edges of the rectangular openings but said width of the neck being less than the summation of the portions on opposite sides of said openings; to space the pairs of notches in said series which are nearest the ends of the rectangular openings a greater distance therefrom than the width of the neck portions; to space the notches in said series a greater distance apart than the width of said neck portions or at least no less a space than the width of said neck portions; to space successive notches in said series a distance no greater than and preferably less than the length of said rectangular openings; and to provide each series of said notches with at least three notches respectively.

Details of the foregoing objects and of the invention, as well as other objects thereof, are set forth in the following specification and illustrated in the accompanying drawings, comprising a part thereof.

DETAILED DESCRIPTION OF THE PREFERRED EMBODIMENT

Figures 1, 2, 3, 4, 5, 6:
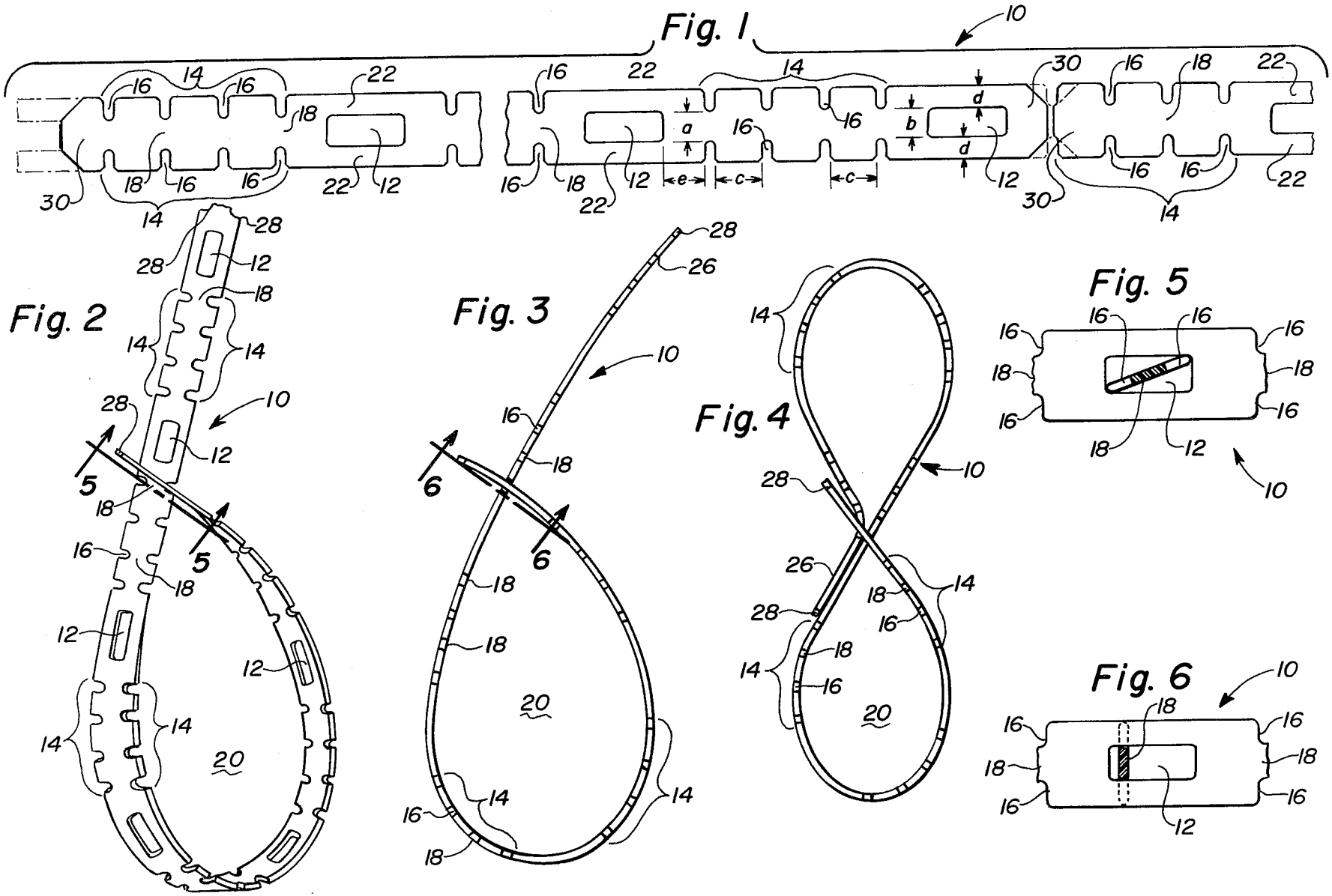
FIG. 1 is a plan view of an exemplary foreshortened strap consisting of a strip of material formed with longitudinally spaced rectangular openings and intervening opposed series of notches formed in the opposite edges in accordance with the principles of the present invention.
FIG. 2 is a view partly in plan, showing the manner of inserting one end of the strap through a selected opening by twisting the same substantially ninety degrees to its otherwise normal position.
FIG. 3 is a view similar to FIG. 2, but showing the strap after the twisted end thereof has been twisted reversely to dispose the portion of the strap between opposed notches within a selected opening.
FIG. 4 is a view similar to FIG. 3 but showing a modified arrangement in which a pair of loops are formed by the strap shown in the preceding figures.
FIG. 5 is a fragmentary sectional view, as seen on the line 5—5 of FIG. 2.
FIG. 6 is a fragmentary sectional view, showing details of the strap in operation, as seen on the line 6—6 of FIG. 3.

Referring to FIG. 1 of the drawing, there is illustrated therein a foreshortened plan view of a strap 10 of indeterminate length and of uniform thickness and width, said strap being formed from flexible plastic material, such as the type sold under the trademark "Mylar", and any appropriate polyethylene compound of suitable strength to enable the strap to encircle bundles of articles, furled bundles of sail, tie the contracted neck of sacks and bags, such as trash bags and the like, and many other similar uses of a tying nature, such as bundles of elongated objects, etc. Without restriction thereto, one suitable width of such material which has been found to be very useful is approximately three-fourth inch in width and a suitable thickness is 0.060 inches, it being understood that said exemplary dimensions are merely for illustrative and not restrictive purposes.

It is preferred in accordance with the principles of the invention that a length of stock plastic strip material of suitable uniform width and thickness be stamped with a series of rectangular openings 12 arranged in substantially spaced longitudinal relationship as clearly shown in FIGS. 1 and 2, equal distances apart and the longest dimension of the openings being arranged longitudinally in the strip and midway between opposite edges thereof. Intermediately between successive openings 12 is a spaced series 14 of notches 16 respectively extending inward from opposite edges of the strip, in opposition to each other in order to provide a neck portion 18 therebetween having a width which is substantially equal to the transverse or narrow dimension of the openings 12. It also is a feature of the invention to provide the corners of openings 12 and the inner ends of notches 16 with small radii to minimize the possibility of breakage occurring at these locations in use.

In the preferred form of this invention, as shown midway in FIG. 1, the neck portion 18 has a transverse dimension or length designated a which is substantially equal to but no greater than width b of the rectangular openings 12. For purposes of providing maximum strength to the strap 10, in the pattern of the notches 16 in series 14 thereof, certain specific proportions have been specifically designed, as follows. The distance c between successive notches 16, see FIG. 1, is no less than width a of the necks 18 and preferably is slightly greater as shown in FIG. 1. Also the width a of the portion 22 of strap 10 on opposite sides of openings 12 is less than width a of necks 18 and the summation of both portions 18 is greater than width a of necks 18; the pairs of notches 16 nearest the ends of openings 12 are spaced therefrom a distance e which is greater than the width a of neck 18; the distance c between successive notches 16 also is greater than the width a of necks 18; and as shown especially in FIG. 1, there are preferably no less than three notches 16 in each series 14 thereof. As a result, the necks 18 are the weakest portions of the strap but this is unavoidable in effecting the locking arrangement of the invention.

To utilize the strap 10 for tying purposes, to secure a bundle of objects together or necked end of a filled bag or sack in closed condition, as well as other similar purposes, one end of the strap is twisted substantially ninety degrees, as shown in FIG. 2, for purposes of permitting insertion of the selected end through any of the openings 12, and then is pulled through said opening to form the loop 20, shown in FIGS. 2 and 3, for example. After the loop has been formed around an object to a desired degree of tightness, such as a sail reefed around a spar, for example, or any of the other aforementioned uses, the end of the strap which has been pulled through the opening 12, when disposed somewhat as illustrated in exemplary manner in FIG. 5, the previously twisted end of the strap is reversely twisted after forming the loop so as to dispose the neck 18 transversely within the opening 12 and the side portions 22 respectively are disposed in a pair of notches 16 nearest opening 12, as shown in FIG. 6, and particularly when said neck is disposed adjacent the far end of the opening 12, considered in respect to the tension placed thereon by the loop 18, said loop will be secured tightly around an object or group of objects. The provision of the series of notches 16 between successive openings 12 affords very precise tightness to loop 20.

From the foregoing, it will be seen that such attachment of the strap 10 around an object or group of objects may be accomplished with minimum ease, requiring no tools, simply by making an initial ninety-degree twist, inserting an end of the strap through a selected opening 12, pulling the strap into a tight loop 20 around the object and then reversely twisting the strap to dispose the neck 16 transversely across the opening 12 adjacent the same when disposed in loop configuration, shown in FIG. 3.

Another advantage of the present invention is illustrated in FIG. 4 in which it will be seen that a double loop arrangement comprising aforementioned loop 20 and additional loop 24 may be formed by the same strap, such, for example, to tie two objects together, as well as securing the same in closed or tight condition. This is accomplished by first forming the loop 20, for example, and then extending the projecting end 26 of the strap through the selected opening 12 which already accommodates a portion of the strap 10 to form the loop 20, and then pulling the strap through the opening while both portions of the strap therein are twisted substantially to the position shown in FIG. 5, after which the straps are restored to the transverse position illustrated, for example, in FIG. 6 with respect to a single strap, following the tightening of the loop 22 around a second object.

From the foregoing, it will be seen that the present invention provides an adjustable tie strap of tough, preferably plastic strip material of uniform width and thickness, certain exemplary dimensions of which are set forth above, without restriction thereto, and by providing strap-receiving openings 12 at regularly spaced intervals therealong, interspersed with intermediate pairs of notches, either one or a pair of loops readily may be provided for typing purposes. Further, by selecting a predetermined length of strip material to form the strap 10 and severing the selected length from stock material by cutting one of the necks 18 evenly midway between the opposite walls of the notches 14, the ends of the strap 10 will be formed with somewhat bevelled corners 28, which at least to a limited extent will serve to facilitate the insertion of a selected end of the strap 10 through a selected opening 12, such as in the manner shown in FIG. 2.

In the event a more pronounced tapered outer end is preferred on the strap, it is possible to form the same by using a knife or scissors to snip corners from the end of the strap and thereby form the tapered ends 30 as shown at one end and intermediately of FIG. 1.

Although there is an arrangement shown in FIG. 4 in which a pair of loops may be formed, it is to be understood that this is merely illustrative of a multiple loop arrangement which may be extended to include as many loops as desired, depending upon how much of the strap is pulled through the initial opening when twisted as described and then reversely twisted to effect a locking of the strap, also as described herein.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

I claim:

1. An adjustable tie strap operable from either end for securing furled sails, bundles, closed bags and sacks and the like comprising in combination, a strip of flexible plastic material of substantial length and tensile strength and uniform thickness and width provided with a series of similar rectangular openings having rounded corners extending therethrough longitudinally along said strip midway between the edges in evenly spaced relationship and the longest dimension of the openings extending longitudinally in said strip, the length of said openings being substantially equal to the width of said strip, and said strip also having a plurality of segments between said rectangular openings extending longitudinally along said strap and each segment being provided along the opposite edges thereof with an interrupted series of at least three similar notches of even depth in each segment and respectively opposite each other and the notches in said series being spaced longitudinally substantially closer than said rectangular openings are spaced and the portions of said strap between successive pairs of notches being no less in length than the width of said neck portions and the distance between successive pairs of notches is less than the length of said rectangular openings, the inner ends of said notches being rounded and spaced from each other across said strip a distance substantially equal to the transverse dimension of said rectangular openings to form a neck portion between said inner ends of said notches, the neck portion of the strap between opposite notches is of greater width than the portions of the strap respectively along opposite sides of said rectangular openings but less than the summation of the two portions on opposite sides of said openings, and the pairs of notches nearest the ends of said rectangular openings being spaced longitudinally from the ends of said openings a distance greater than the width of said neck portions, whereby substantially uniform tensile stress is afforded the strap which is determined by the strength of said neck portions, and when one end of said strap is twisted substantially ninety degrees to the plane of the strap adjacent a selected opening, either adjacent the opposite ends of the strap or otherwise, and then is pulled through said selected opening until a loop of said strap of desired size is formed and a pair of said notches is disposed in said selected opening to permit said strap to be twisted reversely substantially ninety degrees and thereby dispose the neck portion of said strap which is between said notches transversely across said selected opening to secure said loop of the strap tied around an object, the relatively close spacing of the notches of said series thereof affording close adjustment of the band around an article and said pairs of notches nearest the ends of said rectangular openings being spaced longitudinally from the ends of said openings a distance greater than the width of said neck portions.

* * * * *